US006213277B1

(12) United States Patent
Blad et al.

(10) Patent No.: US 6,213,277 B1
(45) Date of Patent: Apr. 10, 2001

(54) COIN OPERATED MACHINE INCLUDING A COIN BOX HAVING A MEMORY DEVICE

(76) Inventors: Steven J. Blad, 2316 Thayer, Henderson, NV (US) 89104; Kenneth R. Dickinson, 8344 Viceroy La., Las Vegas, NV (US) 89117

( * ) Notice: Subject to any disclaimer, the term of this patent is extended or adjusted under 35 U.S.C. 154(b) by 0 days.

(21) Appl. No.: 09/396,550

(22) Filed: Sep. 3, 1999

Related U.S. Application Data

(63) Continuation-in-part of application No. 09/259,207, filed on Mar. 1, 1999.

(51) Int. Cl.[7] ..... G07F 9/06
(52) U.S. Cl. ..... 194/350; 232/15
(58) Field of Search ..... 194/202, 217, 194/350; 232/15, 16; 453/17

(56) References Cited

U.S. PATENT DOCUMENTS 5,469,951 11/1995 Takemoto et al. ..... 194/206
5,531,309 7/1996 Kloss et al. ..... 194/202
5,619,932 * 4/1997 Efland et al. ..... 194/350 X
5,620,079 4/1997 Molbak ..... 194/217
5,732,878 3/1998 Schroder et al. ..... 232/1 D
5,875,879 * 3/1997 Hawthorn ..... 194/350

* cited by examiner

*Primary Examiner*—F. J. Bartuska
(74) *Attorney, Agent, or Firm*—Siemens Patent Services, LC

(57) ABSTRACT

A coin operated machine having a removably insertable coin box for receiving and storing coins inserted into the coin operated machine. The coin operated machine includes a coin accepting apparatus, a first memory device and first circuitry for transmitting communication signals from the first memory device and receiving structure for removably receiving a coin box within the coin operated machine. The coin box has a receptacle partially defined by opposed side walls for receiving and storing coins inserted into the coin operated machine and guiding structure for guiding the coin box into a predetermined position within the receiving structure of the coin operated machine. The coin box also includes a second memory device and second circuitry for transmitting communication signals between the second memory device and the first circuitry.

15 Claims, 9 Drawing Sheets

10

COIN ACCEPTOR
MICROPROCESSOR
32
26
30
MEMORY
34
FUNCTION CONTROL
36
38
DISPENSER
40
43
42
48
12
COIN BOX
44
52
50
54
46
56

FIG. 8
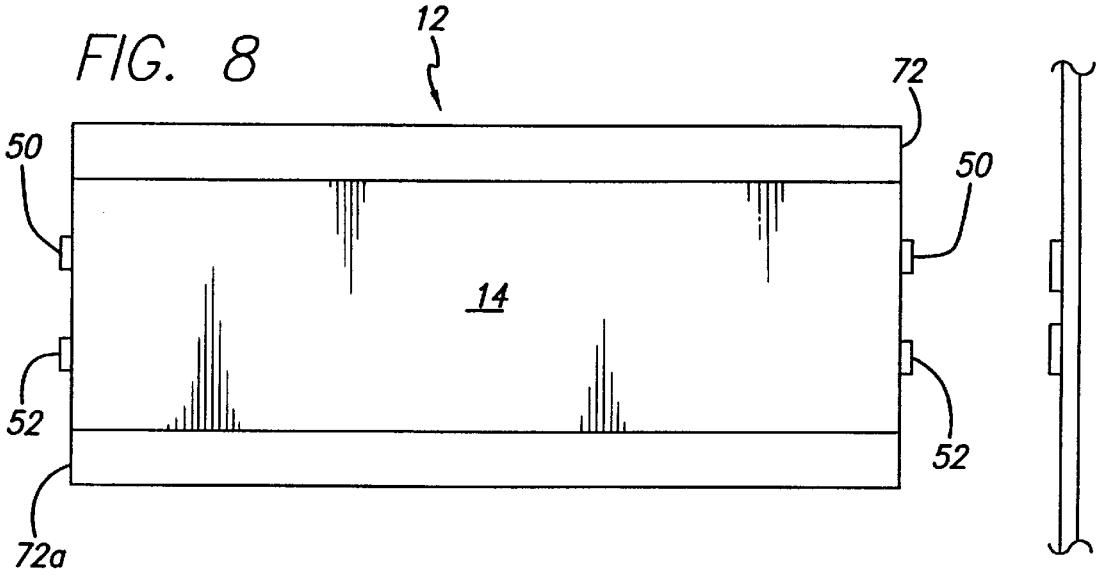
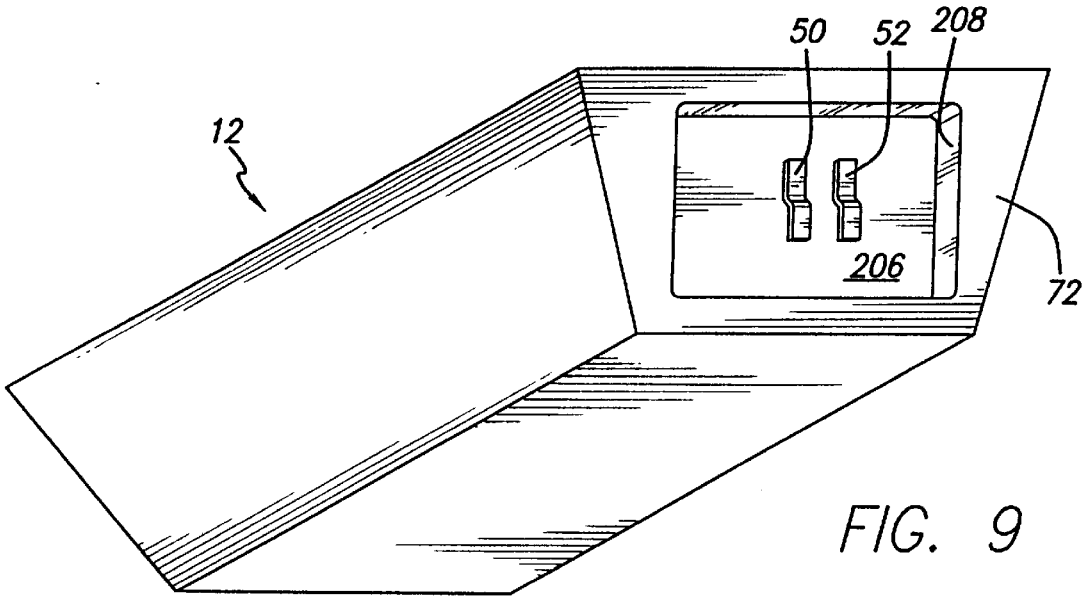
FIG. 9
FIG. 10
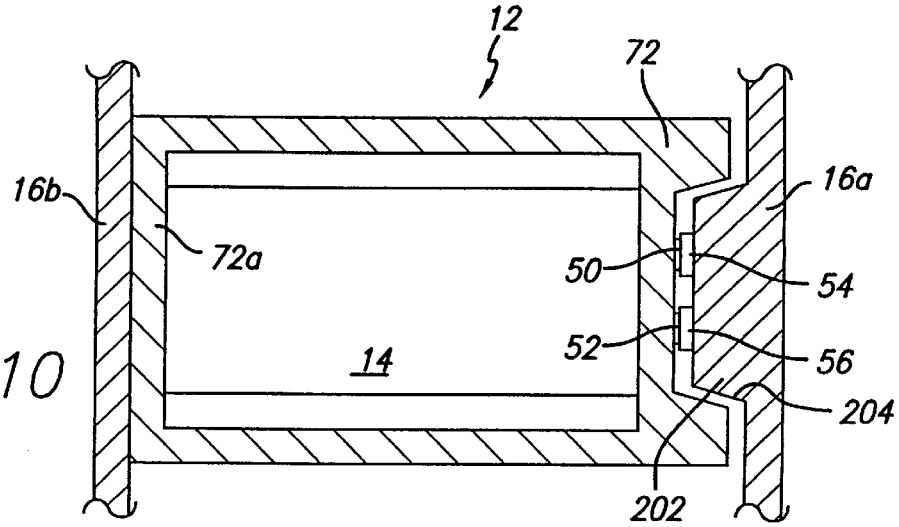

FIG. 12
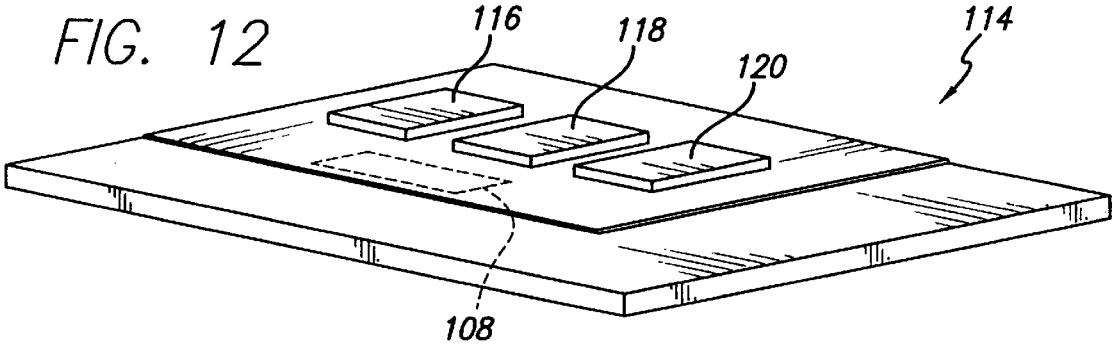
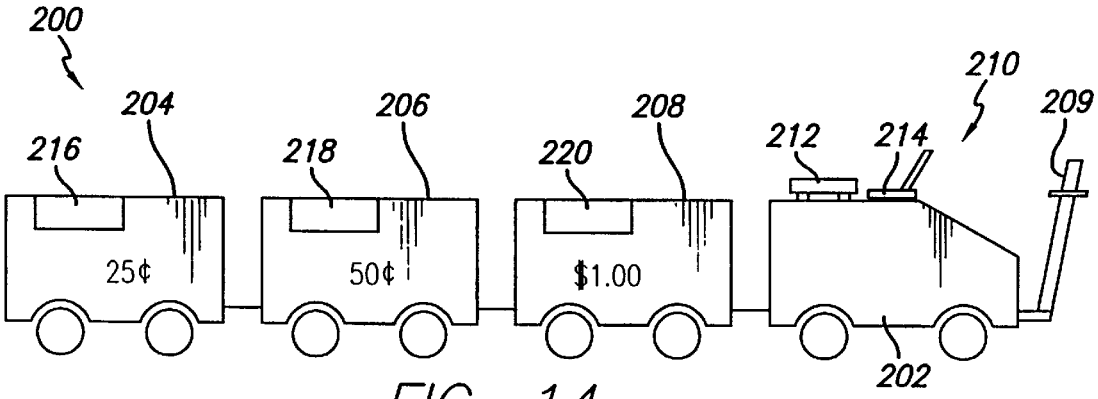
FIG. 14

COIN OPERATED MACHINE INCLUDING A COIN BOX HAVING A MEMORY DEVICE

REFERENCE TO RELATED APPLICATIONS

This application is a continuation-in-part of Application Ser. No. 09/259,207, filed Mar. 1, 1999.

BACKGROUND OF THE INVENTION

1. Field of the Invention

The present invention relates to a coin receiving box associated with operation of a host coin accepting machine. The coin collection box is removable from the machine, and is interchangeably inserted selectively into any one of several similar machines. The coin box contains memory for establishing both temporary and permanent electronic records, and has electrical contact surfaces enabling communication with its host machine. The coin box has guiding structure for assuring that it is correctly inserted into its host machine. Both the guiding structure and the electrical contacts enable reversible insertion into the host machine.

The invention is further directed to a mobile inventorying apparatus and method for receiving moneys such as coins and tokens collected from a slot machine in a secure manner.

2. Description of the Prior Art

Certain activities, such as vending and gaming, are available to the public in commercial premises dedicated to these activities. These premises contain gaming machines which operate automatically when a patron inserts coins or tokens into the machine. Gaming machines tend to amass coins or tokens rapidly, and must periodically be emptied. Since machine operation is equally feasible with coins and tokens, discussion from this point forward will refer to coins, it being understood that tokens may be substituted to similar effect.

In particular, gaming machines are available in large numbers in casinos. Large numbers of people enjoy using these machines, which may all be in use despite the number of machines available. To enable rapid reestablishment of operability after retrieval of coins, gaming machines are provided with interchangeable, removable coin collection boxes. Service personnel employed by the casino come to a gaming machine with an empty coin collection box, remove the full box, and insert the new box. The full box is then brought to a counting facility for accounting and verification of its contents.

Many boxes may be present simultaneously at the counting facility. Various schemes have been employed to enable the casino to know which box is associated with which gaming machine. These schemes use printed numbers on small pieces of paper, or serial numbers printed on the side of coin boxes. Both methods are prone to human error and mistake.

The casino may easily fail to recover all coins which theoretically are present in the coin box. Such loss may stem from either of two possibilities. One is that the bin was misaligned within its host gaming machine, so that some coins could fail to enter the box. In this case, the coins could lodge within recesses in the machine, or be retrieved and pocketed during removal of the box by dishonest personnel servicing the machine. These personnel may also remove coins from the interior of the box, even when the coins have properly entered the box.

Although casinos have automated systems utilizing the master computer for calculating a total sum which theoretically has been amassed by the machines, the system falls short of being able to pinpoint specific causes of loss. This is because large numbers of coin or token bins are received at the counting facilities, and it is not possible to identify which box was short of its calculated receipts. It is merely possible to calculate that the sum of the coins actually collected falls short of theoretical receipts. Thus the operator of the premises cannot identify poorly installed bins and dishonest employees.

A coin receiving machine having a removable coin collection box and electronic memory devices contained within both machine and box is shown in U.S. Pat. No. 5,056,643, issued to Bernd Kirberg on Oct. 15, 1991. Kirberg's device is a vending machine rather than a gaming machine, and lacks the arrangement of guiding structure assuring appropriate and reversible mating of the coin collection box within the host machine and electrical contacts found in the present invention.

Mechanical disconnection of an electronic memory device within a coin receiving machine upon removal of a coin collecting receptacle is shown in U.S. Pat. No. 5,485,285, issued to Jerome Remien on Oct. 17, 1995. Remien's machine is not a gaming machine, and lacks the arrangement of guiding structure assuring appropriate and reversible mating of the coin collection box within the host machine and electrical contacts found in the present invention.

Keyed insertion of a coin collecting receptacle into a host machine is exemplified in U.S. Pat. No. 2,371,114, issued to Walter Von Stoeser on Mar. 6, 1945. Stoeser's arrangement does not allow for reversible insertion of the receptacle, as provided in the present invention. Also, Stoeser's machine is not a gaming machine, and lacks electronic memory and electrical contacts enabling communication to electronic memory, as found in the present invention.

None of the above inventions and patents, taken either singly or in combination, is seen to describe the instant invention as claimed.

SUMMARY OF THE INVENTION

The present invention provides structural cooperation between a coin collecting box and its host machine so that the box is reversibly insertable into the host machine and so that accurate positioning of the box within the host machine is assured. The coin box and the cavity of the host machine are each provided with complementary grooves or projections assuring appropriate alignment of the box.

A preferred configuration of guiding members includes a low upwardly oriented projection disposed upon the flat floor of the cavity of the host machine. The coin box has a flat floor including short depending walls which partially surround and closely cooperate with the projection when the coin box is fully inserted and lowered into position. Both the projection of the host machine and the walls of the coin box are inclined, so that lowering the coin box also centers the coin box over the projection. The coin box is configured to avoid cracks and crevices into which coins may lodge, be concealed, or otherwise be lost.

The host machine and the coin box are each provided with electronic memory devices for storing information relating to the identity of each and with circuitry enabling communication between the two memory devices. Each memory device receives information relating at a minimum to the identity of its partner memory device. Therefore, when the coin box is returned to the mounting facility, the operators of the casino may ascertain which coin box has been associated with which gaming machine. Other memory devices may receive information relating to coin count as well. Therefore, any shortage of coins will be attributable to the correct source of the loss, and remedial steps may then be taken. At the same time, counting and verification of other machines and coin boxes may proceed independently of a short count relating to any one particular coin box.

To enable communication between box and host machine, electrical contacts are provided in each such that they will be operable regardless of direction of insertion of the coin box into the host machine. The communication circuits completed by mating of these contacts are separable, or broken when the coin box is removed. Contact is preferably sliding in nature rather than depending upon interfering abutment. Effective contact may then ensue without requiring the extreme precision required for abutting contact.

The arrangement of the contacts reduces requirements for precision when mating. Unlike connection devices such as multipin connectors, which must be carefully aligned prior to mutual engagement, the electrical contacts act automatically, requiring no attention from the installing personnel whatsoever. Physical alignment of the coin box within the cavity of the host machine is the only requirement. Cooperation between the depending walls of the coin box and the projection of the host machine assures that it is nearly impossible to misalign the two.

The electrical contacts are disposed upon the flat upper surface of the projection of the host machine and upon the flat floor of the coin box. In an alternative to actual contact, communicable engagement may be accomplished by induction. Coils embedded within the box and the host machine on the flat surfaces will cause signals to be transferred inductively without resorting to actual contact.

According to another aspect of the invention, a mobile inventorying and collection apparatus provides for immediate inventorying of moneys collected in the coin box at an area adjacent to the host machine, and transfer of the inventoried monies to a secured receptacle on-board the mobile apparatus, preferably for later transfer to a secured coin repository. Host machines may be gaming machines, vending machines, change machines or other machines in which monies are collected, without limitation. The mobile apparatus may be a transportable cart or other conveyance for supporting the system components described below in greater detail.

The system preferably includes the coin box which is interchangeably received by both the host machine for initial collection and the mobile cart for measurement, including weighing collected moneys on a scale provided on the mobile apparatus. Information identifying the coin box and inventory information specific to the coins and tokens received and collected from the host machine is transmitted to either a CPU provided on-board the mobile cart for later downloading to a remote data management system, or directly to the remote data management system. Such data transmission may be concurrent with collection processing, or batch downloaded after collection of moneys from a plurality of host machines. After the coin box has been inventoried, its contents are then transferred to a secure receptacle provided onboard the mobile cart, and the coin box is returned to its designated host machine for subsequent coin collection, thereby immediately placing the host machine, such as a gaming machine, back in service using the original coin box.

The coins/tokens may be segregated by numerical denomination in the mobile inventorying system, for separate secured retention in corresponding receptacles provided in the mobile cart. Paper money or scrip may be collected and accounted for by the apparatus of the invention. The mobile cart is then preferably advanced to a subsequent host machine as necessary to inventory all host machines in a particular location and efficiently and securely collect monies in the manner previously described. The mobile cart may be retrofittable to existing cart systems, configured to hand or vehicle transfer systems, or self-propelled in an automatic delivery system to deliver inventoried moneys to a remote count room or other receiving facility. According to another embodiment of the invention, the mobile apparatus includes a self-propelled tow vehicle provided with inventorying and collection apparatus and one or more coin collection carts, each having one or more secure receptacles, to be towed by the tow vehicle adjacent to the host machines to be inventoried.

Other objects, features and advantages of the present invention will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein:

FIG. 8 is an exploded top plan view of the coin collection box of FIG. 7 and the inside wall of a gaming machine having contacts thereon.

FIG. 9 is a perspective view of a coin collection box having guiding structure including contacts in the side thereof.

FIG. 10 is a cross-sectional top plan view of the coin collection box of FIG. 9 inserted into a gaming machine.

FIG. 12 is a perspective view of a coin collection box receiving platform to be mounted to the mobile cart of the present invention for receiving and weighing a coin box according to the invention.

FIG. 14 is a perspective, diagrammatic view of another embodiment of the inventorying and collection apparatus of the present invention, showing a self-propelled propelled tow vehicle for pulling a train of money collection carts, each cart including at least one secure coin/token receiving bin.

DETAILED DESCRIPTION OF THE PREFERRED EMBODIMENTS

Figure 1:
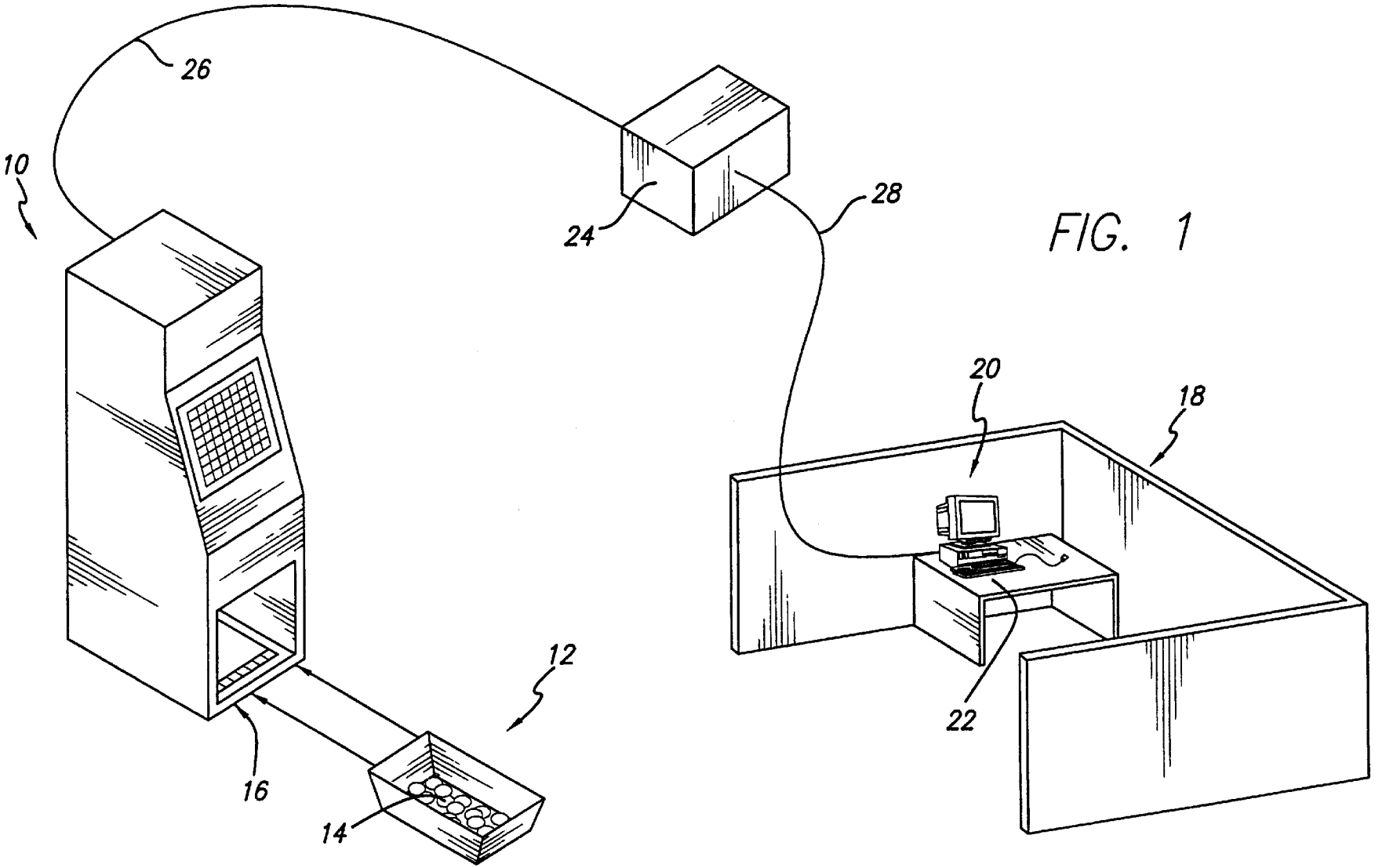
FIG. 1 is a perspective, environmental, diagrammatic view of the coin collection system of the invention, showing slot machine coin collection application in a casino.

FIG. 1 shows the present invention as it would be employed in a casino (not shown in its entirety). The invention comprises a coin operated machine 10 having a removably insertable coin collection box 12 for receiving and storing coins 14 inserted into machine 10. It will be understood that the coin collection box 12 may be used to collect paper money and scripp according to the invention, for use with machines 10 that require paper money or scripp for operation. Coin box 12 is periodically removed for counting and retrieving coins 14. A similar coin box (not shown) is inserted into a cavity 16 serving as a receptacle for containing coin box 12 when machine 10 is in use. Coin box 12 is designed to be reversibly inserted into cavity 16 in the interests of efficiently replacing coin boxes and expeditiously returning machine 10 to active service.

In a typical casino, coin box 12 is carried on a cart (not shown) together with other coin boxes (not shown) to a counting facility 18 for retrieval of coins and reconciling of accounts. Counting facility 18 has a computer monitor 20 and a keyboard 22. Machine 10 has a memory device (see FIG. 2) which is employed in tracking receipts and disbursements made by machine 10. This information is communicated to a central computer 24, which includes another memory device, by any suitable method, such as by cable 26. Monitor 20 and keyboard 22 communicate with computer 24 by cable 28. Information contained in the two memories further includes data identifying which coin box has served machine 10 during a specified time period. The operator of the casino may thus account for shortages in the count of retrieved coins, and may pinpoint the source of any loss as accruing from pilferage or from mechanical failure. Identities of the personnel removing and returning coin box 12 may also be tracked in the memories.

Figure 2:
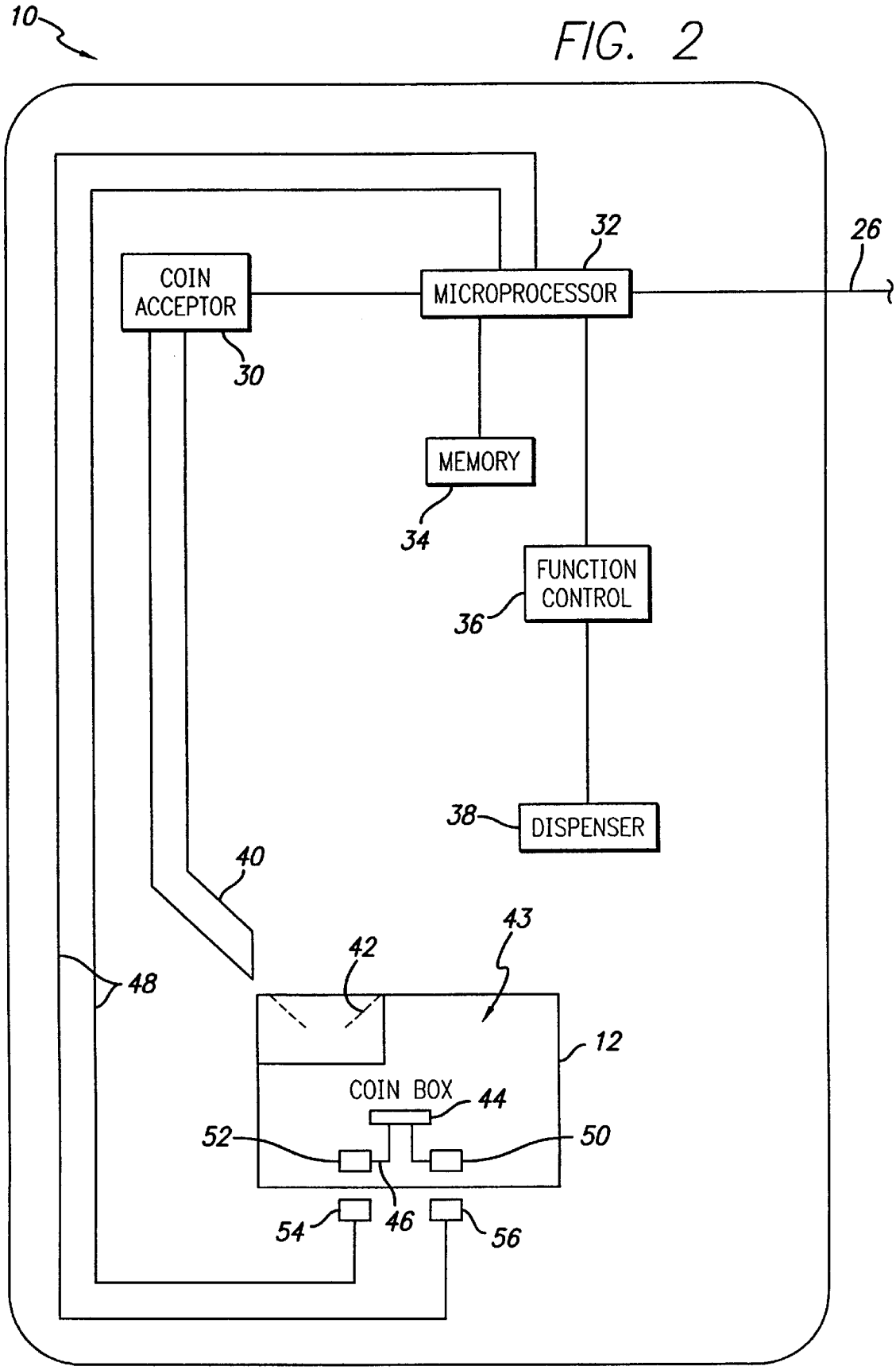
FIG. 2 is a front elevational, diagrammatic view of the invention.

FIG. 2 shows typical components of machine 10. A coin accepting apparatus 30 receives coins, verifies authenticity and value of coins, and sends a signal to a microprocessor 32 enabling activities to proceed if sufficient value has been received. Microprocessor 32 has an associated memory device, such as RAM 34. A function controller 36 is enabled by a signal from microprocessor 32 to accept commands from the patron of machine 10 responsive to acceptance of a coin by coin accepting apparatus 30 and determination of sufficient value for the requested function.

In gaming machines, the function will relate to gaming or gambling. In this case, the function will be performing a calculation of a random chance result, and dispensing a return based upon the chance result. The return, made by a dispenser 38, may be a payoff if the chance result favors the patron, and will result in retention of inserted money by machine 10 if the chance result does not favor the patron.

The present invention is equally applicable to machines performing functions other than gaming. For example, the machine may be a vending machine (not shown). If this were the case, then dispenser 38 would comprise well known apparatus for selecting and dispensing merchandise, and optionally for making change.

Coin box 12 is diagrammatically shown in a predetermined, operative position within machine 10. This signifies that coin box 12 is correctly positioned to successfully receive coins delivered thereinto by machine 10, thereby defeating a potential source of loss, i.e., spillage past the coin box 12. If the function being performed results in a determination that an inserted coin should be retained by machine 10, then that coin is routed to coin box 12. This is indicated diagrammatically by chute 40. Alignment of chute 40 with coin guide 42, which leads to a coin storage receptacle 43, represents the operative position of coin box 12 within machine 10.

Of course, machine 10 may retain coins for potential return to the patron. Apparatus for accomplishing this is well known and may be incorporated for the successful operation of machine 10 if desired.

The operative position further signifies that coin box 12 is properly aligned to assure completion or connection of communications circuitry. It being recalled that coin box 12 has a memory device 44, circuitry 46 is provided to transmit signals to memory device 44. Circuitry 46 is connected to complementary circuitry 48, which complementary circuitry 48 is in turn connected to memory device 34. Final connections are made by electrodes 50, 52 of circuitry 46 and electrodes 54, 46 of circuitry 48. Cable 26 may be regarded as a further component of circuitry 48, and performs the function of transmitting communication signals between microprocessor 32 and its associated memory device 34 and external computer 24 and its associated memory device (not shown apart from computer 24).

An operator may utilize keyboard 22 to query microprocessor 32 of machine 10, in order to receive information from machine 10 prior to receiving coin box 12. The same information available from microprocessor 32 may be entered into memory device 44 of coin box 12. Alternatively, some information may be restricted from memory device 34 or from memory device 44, so that there may be a difference in entered data between these components. Many algorithms or programs may be utilized in controlling and communicating between computer 24 and memory devices 34 and 44, depending upon the exact functions to be performed. These algorithms are well known or may be created especially for the application by those of skill in the art.

Information gathered by the memory device 34 can include host machine 10 identification, time and date information, and data transferred from a coin meter 125 (FIG. 3) in the host machine. It will be understood that the data other than coin meter data can be monitored by meters within the host machine 10, which are preferably associated with the memory device 34. The electronic monitoring system of the host machine 10 (which is associated with memory device 34) can monitor any electrical signal generated by the host machine 10. For example, door open signals, signals generated by the coin acceptor mechanism and signals generated by the bill acceptor mechanism can be monitored. These signals can be counted or analyzed to generate additional information that can be stored in the data chip in the base of the coin collection box 12 for later transfer to the central computer 24. Door open signals can be generated by, for example, an electric switch whose contacts are opened and closed when the door is pressed against the switch. The electronic monitoring system monitors the voltage going through the switch to determine the state of the door (opened or closed). Any mechanical movement within the machine can be monitored by the electronic monitoring system by attaching an electronic position sensor to the mechanical device to be monitored.

In a preferred embodiment, the host machine 10 includes electrical ouptuts that correspond to certain events that are monitored by the electronic monitoring system. The outputs may be lights, bells, buzzers, whistles, relays or the like. For example, if the host machine 10 includes a switch for monitoring the status of the door (opened or closed) a corresponding light may be included in the host machine 10. Therefore, when the door is ajar, the light is lit, thereby alerting the operator that the door is ajar. Other signals/outputs, such as bucket in position (on or off contacts), illegal bucket in position, bucket full, data tampering detected, and the like, are within the scope of the present invention.

Figure 3:
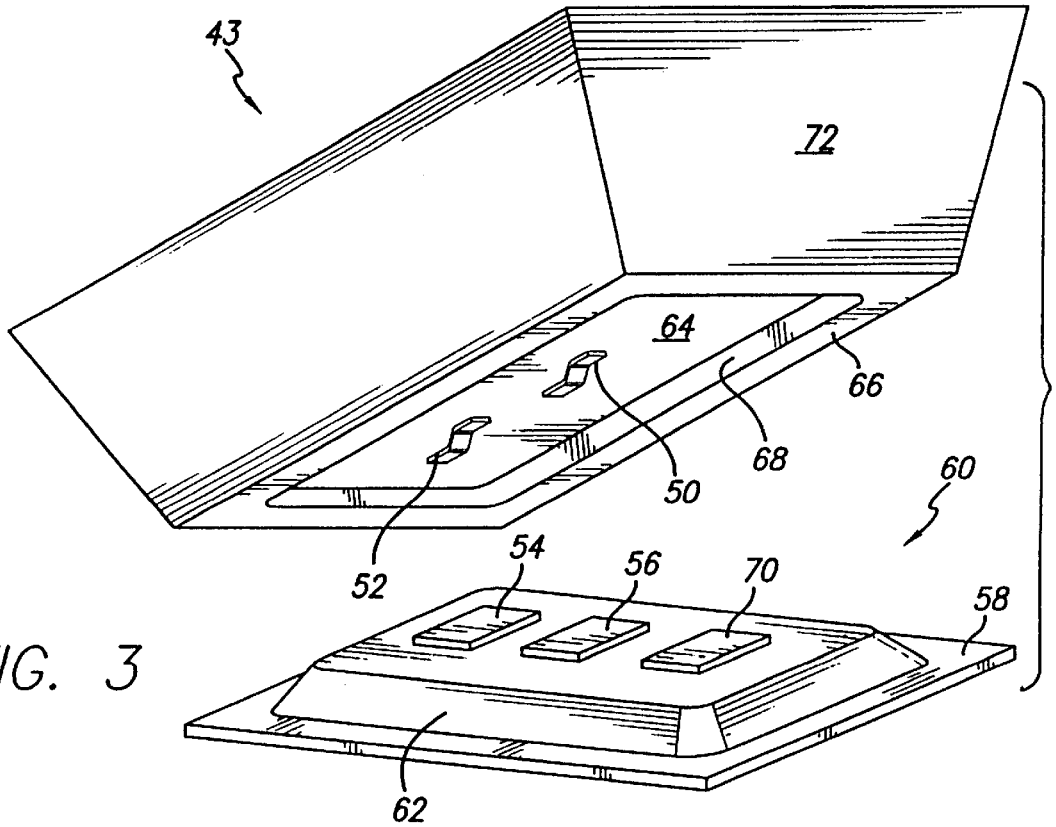
FIG. 3 is an exploded perspective detail view of components seen at the bottom of FIG. 2.
Figure 4:
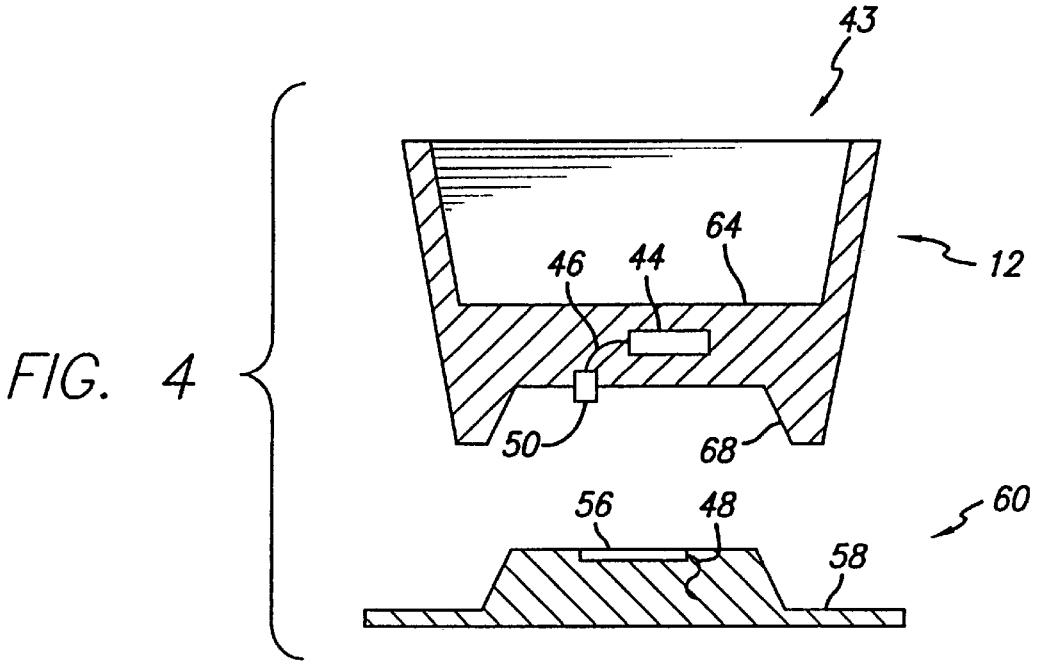
FIG. 4 is a front cross sectional view of the components of FIG. 3.

Interfitting cooperation between coin box 12 and cavity 16 (see FIG. 1) is shown in FIGS. 3 and 4. Cavity 16 has receiving structure for removably receiving and locating coin box 12, comprising a floor 58 and a projection 60 projecting upwardly from floor 58. Projection 60 has an inclined lateral wall 62 which gives projection 60 a tapered configuration wherein the top is smaller than the bottom. Coin box 12 has guiding structure including a bottom panel 64 and a wall 66 depending from bottom panel 64. Wall 66 has an inclined surface 68 complementing and closely cooperating with tapered projection 60.

When coin box 12 is inserted into cavity 16 and released, coin box 12 will be urged by gravity to attain the predetermined position, shown representatively in FIG. 2, beneath chute 40 (see FIG. 2) or equivalent structure for depositing coins into receptacle 43.

In the present example, corresponding inclination of wall 62 and surface 68 urges coin box 12 to become centered over projection 60. Of course, inclination of wall 62 an d surface 68 could be reversed to the same effect. In other embodiments, it would be possible that corresponding receiving structure of a coin operated machine and guiding structure of the coin box be differently configured. For example, the coin box could be urged to the left, right, or to the rear, or to an intermediate position having combined characteristics of these directions.

Electrodes 50, 52 and 54, 56 and their respective alignment are also shown in FIG. 3. Electrodes 50 and 52 are exposed from below panel 64, and will make physical contact with electrodes 54, 56, which are exposed from above projection 60 when coin box 12 is lowered into the predetermined position.

Preferably, contact is sliding contact, rather than requiring penetration and consequent careful alignment of the respective male and female electrodes (not shown). In addition to sliding contact, electrodes 50, 52 and 54, 56 are arranged serially with respect to the direction of insertion of said coin box into said coin operated machine, so that coin box 12 need be moved in a straight line, and not necessarily moved in a complex manner to assure mating of the contacts 50, 52, 54, 56. The relative large size of one of the two sets of electrodes 50, 52 or 54, 56 assures contact even if coin box 12 is slightly misaligned relative to projection 60.

An additional electrode 70 is disposed upon projection 60 and connected in common with electrode 54. This arrangement assures that coin box 12, which is of symmetrical construction, may be inserted into cavity 16 with end wall 72 facing either to the rear of machine 10 or to the front thereof. Thus, machine 10 and coin box 12 are arranged to accept reversible insertion of the latter into the former. Simultaneously, electrodes 50, 52, and their corresponding electrodes 54, 56 of projection 60 are linearly alignable regardless of directional orientation of coin box 12 within machine 10, and will come into operative proximity when coin box 12 attains its predetermined position within operated machine 10.

Figure 3A:
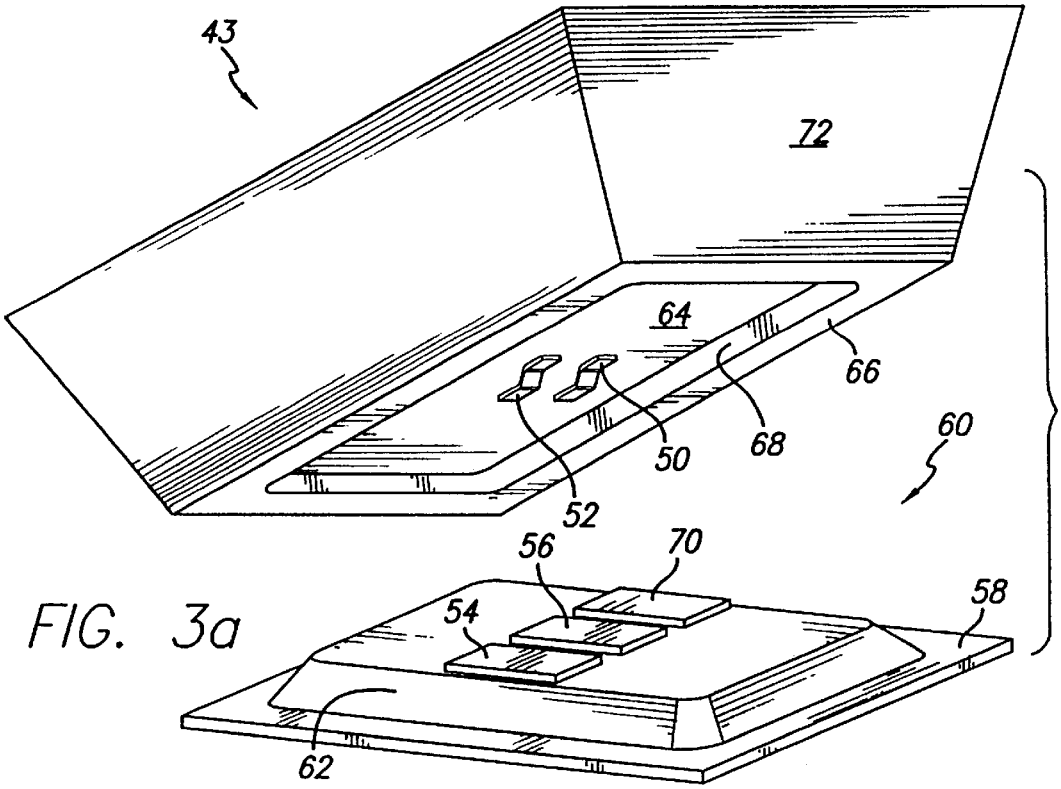
FIG. 3*a* is an exploded perspective detail view of components seen at the bottom of FIG. 2. having an alternative electrodes arrangement.

In another embodiment, as shown in FIG. 3*a*, electrodes 50, 52 can be arranged in a side by side arrangement, such that they are normal to the direction of insertion the coin box 12. In this embodiment, electrode 50 is placed in the center of the coin box 12, relative to end walls 72, 72*a* and electrode 52 is offset therefrom. Electrodes 54, 56, 70 are affixed to projection 60 such that electrode 56 is in the center thereof, and the electrodes 54 and 56 are on either side of electrode 56. Therefore, the coin box 12 can be reversibly inserted into cavity 16 without regard to the orientation of coin box 12. It will be understood that a non-symmetrical coin box 12 is within the scope of the present invention. In such a case electrode 70 can be omitted and directional orientation of coin box 12 is not reversible.

FIG. 4 shows a preferred configuration of coin box 12 wherein upwardly projecting lateral walls of receptacle 43 are inclined such that the top of receptacle 43 is wider than the bottom thereof, and all internal surfaces are continuous and lack cracks and crevices which could otherwise trap or conceal coins. This view also shows the close cooperation between projection 60 and surface 68, and the arrangement of memory device 44 and contact 50 within panel 64.

Figure 5:
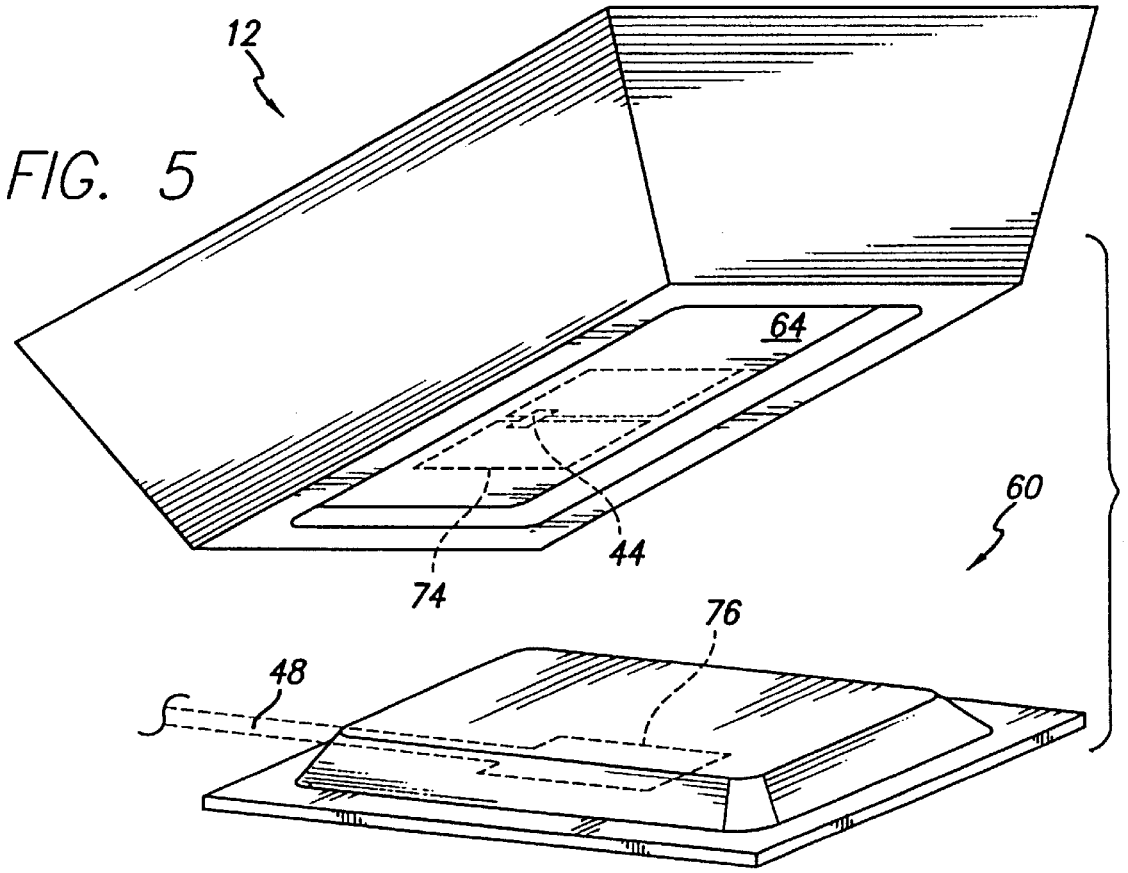
FIG. 5 is a view similar to that of FIG. 3, but illustrating a first alternative embodiment.

The arrangement of contacting electrode 50, 52, 54, 56 may be replaced by electrodes featuring non-contacting communication. As shown in FIG. 5, coin box 12 may be provided with an induction coil 74 embedded within panel 64 and connected to memory device 44. Machine 10 has a corresponding induction coil 76 embedded within projection 60, which coil 76 communicates with memory device 34 (see FIG. 2) through circuitry 48. Even though physical contact is absent, operative proximity enables coils 74 and 76 to transmit signals to one another.

Obviously, one of coils 74 or 76 may be replaced by a metal structure the form of which is not critical, in order to react appropriately with the electromagnetic field, depending upon the desired direction of communication. Where a coil 74 or 76 is provided, it will be understood to include a suitable power supply (not shown). The use of inductive coils for communicating signals is conventional, and these coils are shown only in representative capacity in FIG. 5.

Figure 6:
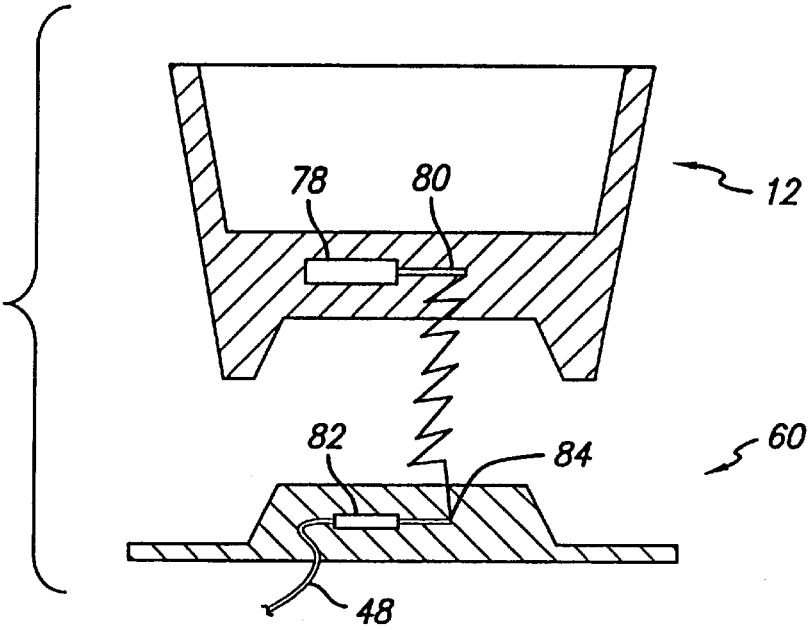
FIG. 6 is a view similar to that of FIG. 4, but illustrating a second alternative embodiment.

Another form of electrodes providing non-contact communication is shown in FIG. 6. Coin box 12 has a radio frequency transmitter and receiver 78 and an associated antenna 80. Of course, transmitter and receiver 78 is connected to memory device 44, although not shown in FIG. 6. Machine 10 has a corresponding radio frequency transmitter and receiver 82 having a respective associated antenna 84. The respective devices indicated as 78 and 82 may, of course, comprise only a transmitter or only a receiver, depending upon the desired scheme of communication. In the embodiments of FIGS. 5 and 6, signal strength will be predetermined so that communication is established only when a predetermined proximity between the communicating elements is attained.

Figure 7:
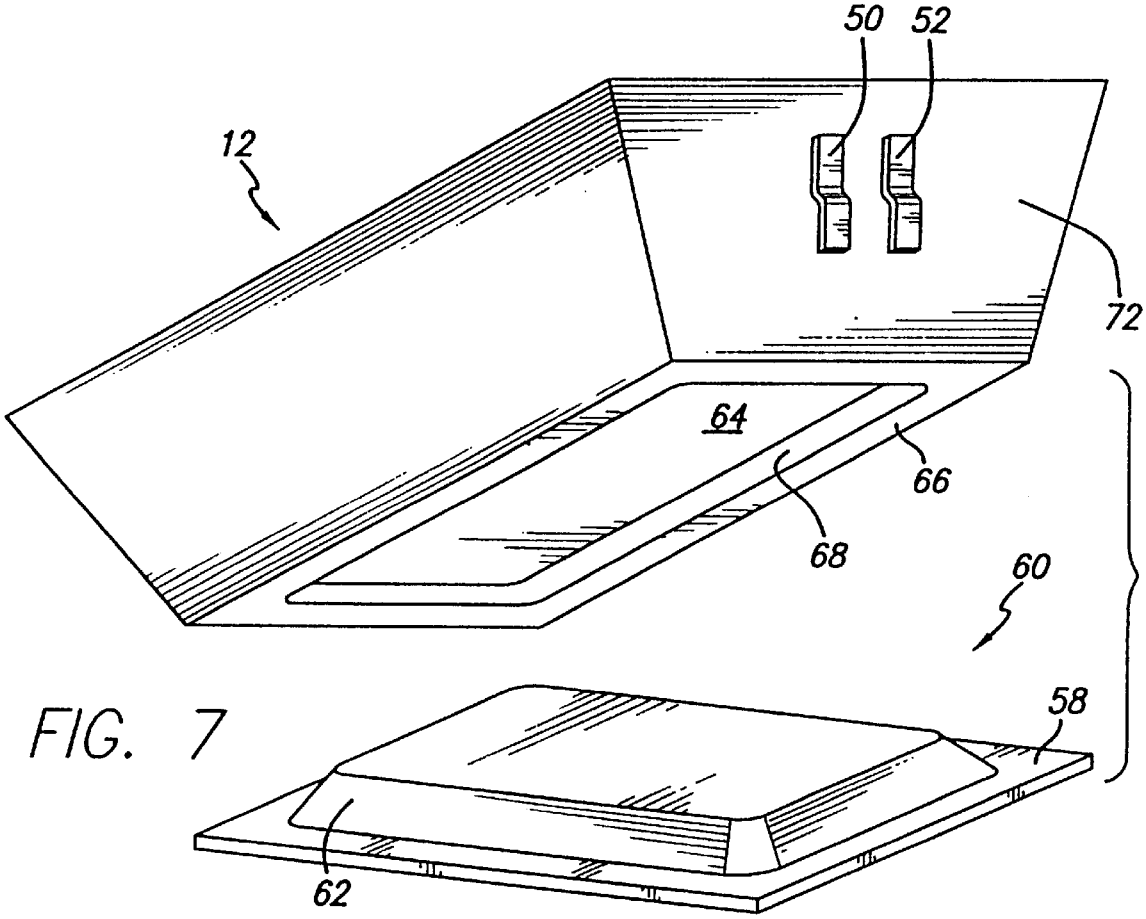
FIG. 7 is an exploded perspective detail view of a coin collection box having contacts on the side thereof and a corresponding projection.

FIGS. 7–8 show an embodiment of a coin collection box 12 that includes contacting electrodes 50, 52 on end wall 72.

Contacting electrodes 50, 52 are shown in FIGS. 7–8 in a horizontal orientation, however it will be understood that contacts 50, 52 can be arranged in any orientation, such as vertical or diagonal. One of the inside walls 16*a* that defines cavity 16 (see FIG. 1) includes electrodes 54, 56. When coin collection box 12 is inserted into cavity 16, and the guiding structure (via gravity) locates the box 12 in its predetermined position, the contacting electrodes 50 and 52 will make physical contact with electrodes 54, 56.

Preferably, electrodes 54, 56 are located on the wall 16*a* opposite the opening into which the coin collection box 12 is inserted into cavity 16. It will be understood that contacting electrodes 50 and 52 can be located on end wall 72 and opposite end wall 72*a* (as shown in FIG. 8) so that the box 12 can be inserted into cavity 16 with end wall 72 facing either to the rear of machine 10 or to the front thereof. Thus, machine 10 and coin box 12 are arranged to accept reversible insertion of the latter into the former. It will be understood that contacting electrodes may be located on any of the end or side walls of coin collection box 12.

FIGS. 9–10 show another embodiment of a coin collection box 12 that includes contacting electrodes 50, 52 on end wall 72. In this embodiment, cavity 16 has receiving structure for removably receiving and locating coin box 12. However, the guiding structure is omitted from the bottom of coin collection box 12 and is included on end wall 72. The receiving structure includes a wall 16*a* and a projection 202 projecting outwardly from wall 16*a*. Projection 202 has an inclined lateral wall 204 which gives projection 202 a tapered configuration. Coin box 12 has guiding structure including a side panel 206 and end wall 72 depending from side panel 206. End wall 72 has an inclined surface 208 complementing and closely cooperating with tapered projection 202.

When coin box 12 is inserted into cavity 16, coin box 12 will attain the predetermined position beneath chute 40 (see FIG. 2) or equivalent structure for depositing coins into receptacle 43 as a result of the guiding structure. In a preferred embodiment, contact electrodes 50, 52 are held in contact relationship with electrodes 54, 56 by door 16*b*. As shown in FIG. 10, when door 16*b* is closed it contacts end wall 72*a*, thereby urging contact electrodes 50, 52 into contact relationship with electrodes 54, 56.

Of course, inclination of wall 204 and surface 208 could be reversed to the same effect. Further, the entire guiding structure could be included on another side or end wall of the coin box 12.

Variations and modifications to the invention may be introduced by those of skill in the art. For example, coin box 12 may be modified so that the front and rear sections of wall 66 enable sliding of coin box 12 on projection 60. Other structure (not shown) may be provided for supporting coin box 12 as it is slid into and out of its operative position within machine 10. Although electronic data handling has been described, optical and other systems may be substituted in whole or in part to similar effect. A handle may be located on the front of the coin box 12 to aid a technician in removing and inserting the coin box 12. End wall 72*a* may include a press surface, such as an elastomeric material, for door 16*b* to contact to aid in urging coin box 12 toward wall 16*a*.

Figure 11:
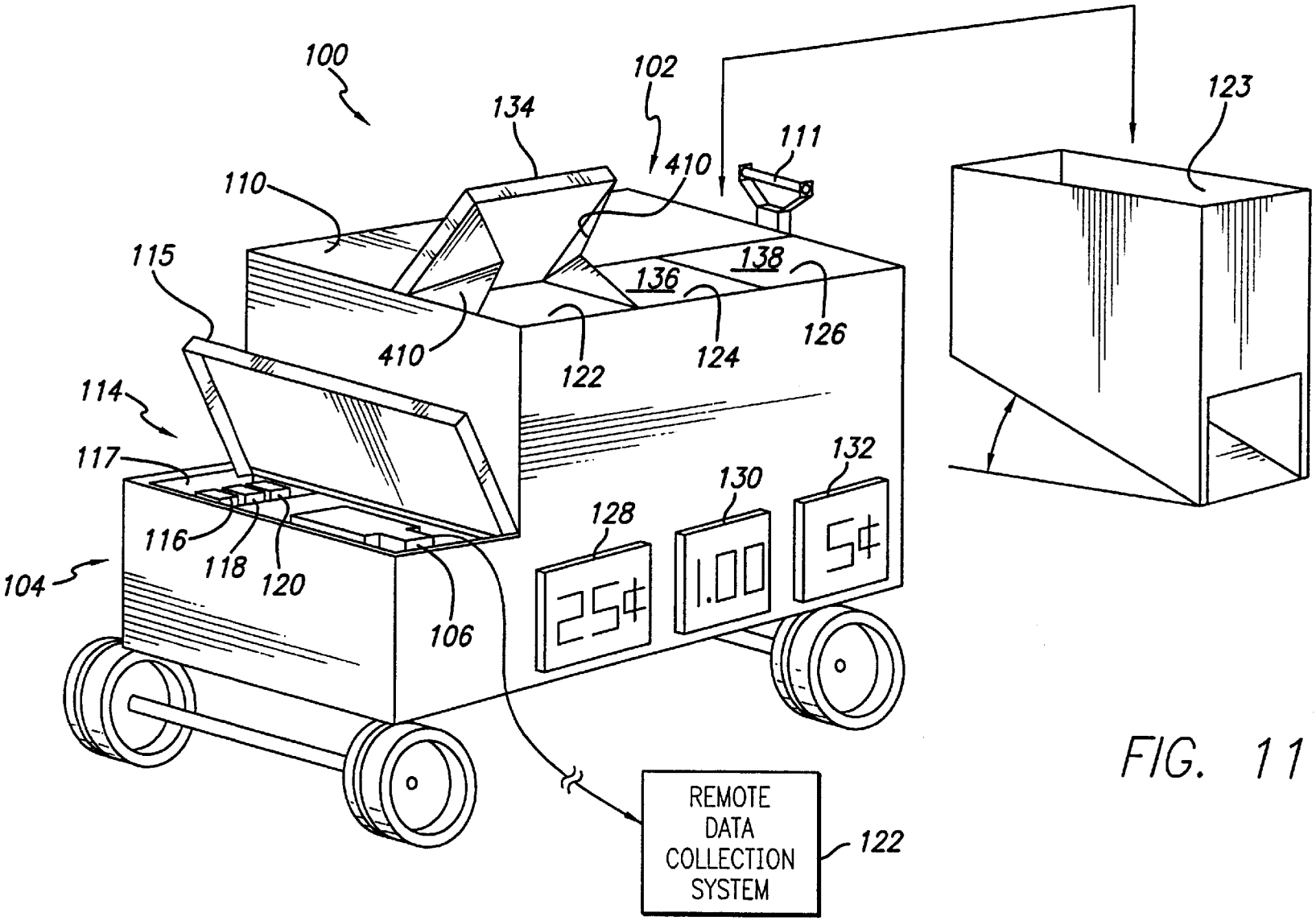
FIG. 11 is a perspective, diagrammatic view of one embodiment of the mobile cart of the present invention, showing a plurality of individual coin/token receiving bins, scale and a CPU mounted on-board the mobile cart.
Figure 13:
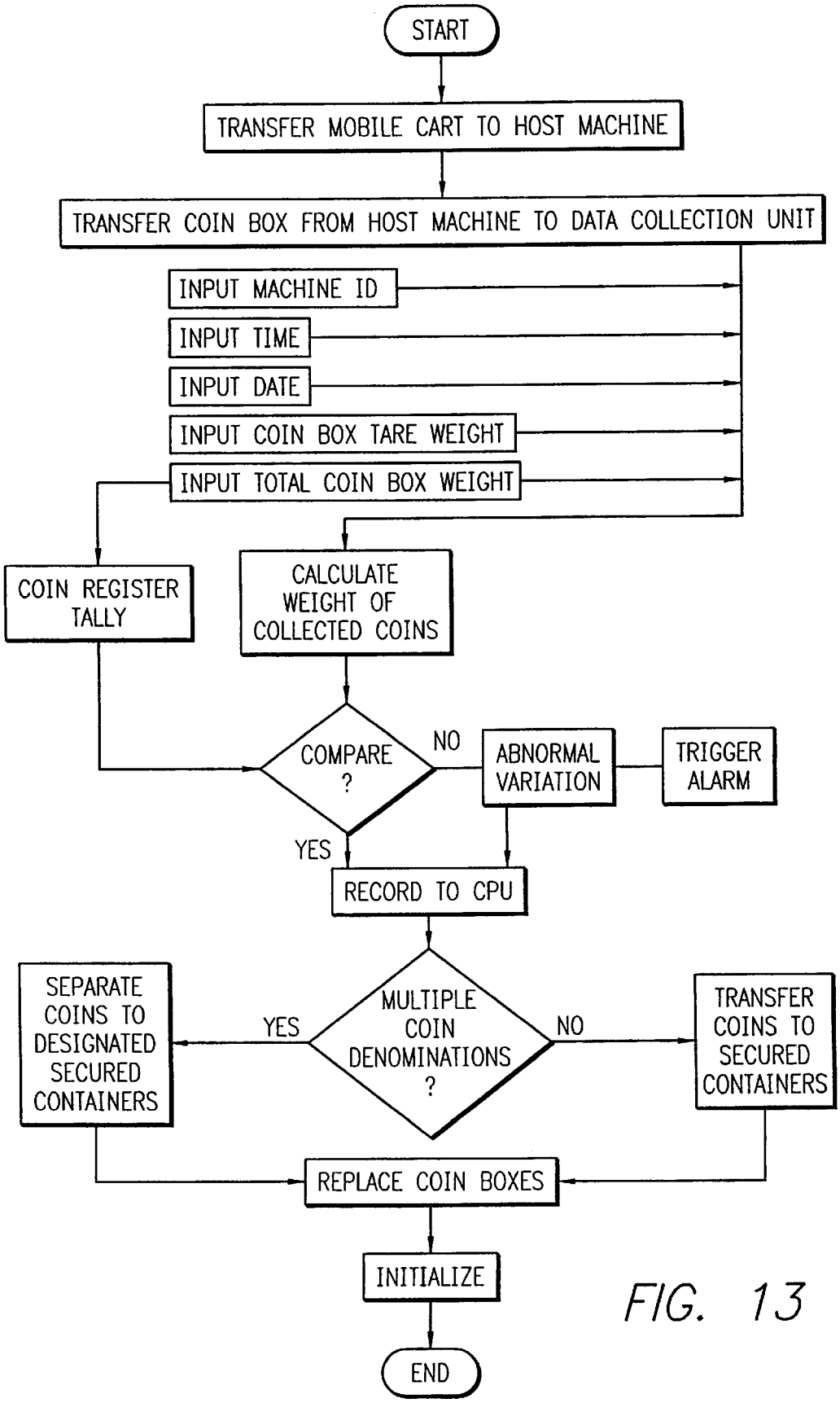
FIG. 13 is a flow chart of a method of receiving and inventorying coins/tokens collected from a host machine, and transmission of equipment- and inventory-specific information and data to on-board and remote CPUs.

As a further improvement, and with reference now to FIGS. 11–13, a mobile inventorying system 100 includes a mobile cart 102 provided with inventorying apparatus 104 for immediate inventorying of moneys such as coins or tokens collected in the coin box 12 (FIG. 1) at an area adjacent to the host machine 10, thereby eliminating the requirement to return the coin box 12 to a remotely-located counting facility to inventory coins/tokens received by the host machine 10. This system is also applicable to the efficient and accurate collection of paper money or scrip, utilizing the apparatus of the present invention to read and transfer the counts of paper money or scrip to the computer system. The system of the present invention is applicable to gaming machines, vending machines, change machines or other machines in which monies are collected, without limitation.

Inventorying apparatus 104 can include an on-board data collection unit CPU 106, an on-board calibrated scale 108, and at least one secure coin/token receiving container 110. The system preferably includes the coin box 12 for receiving and inventorying coins and tokens received from the host machine 10, and transmitting this data as well as identification data of the coin box 12 to either the on-board CPU 106 provided on-board the mobile cart 102 for later downloading to a remote data management system 120 (and/or central computer 24), or directly to the remote data collection system 120. The coins/tokens may be segregated by denomination in the mobile inventorying system 100. It will be understood that the identification data of coin box 12 can include, without limitation, and combination of host machine identification, coin count information and/or time/date information.

Processing then continues to additional host machines 10 as necessary to inventory all host machines in a particular location of, for example, a casino, and efficiently and immediately update gaming or other money receipts for those coins/tokens received in coin box 12 provided therein in the manner previously described. After each coin box 12 has been inventoried and its contents transferred to the secure coin/token receiving container 110, the coin box 12 is reinstalled in the designated cavity 16 provided in its designated host machine 10. The system components may be installed on a mobile cart 102, or alternatively may be provided on a support structure retrofittably affixable to existing portable wheeled cart systems for operation along tracked or untracked pathways, configured for manual or machine-propelled transfer systems by tow handle 111, or self-propelled under automatic robotic delivery system control to deliver inventoried moneys to a remote count room or other receiving facility.

Specifically, the inventorying apparatus 104 includes a receiving system in which the coin box 12 is removably received on a receiving platform 114 provided with electrically or inductively coupled contacts and circuitry configured for achieving a desired electrical connection of electrodes 50, 52, 70 of the coin box 12 in the manner previously described. An additional set of complementary contacts 116, 118 and electrode 120 (corresponding to contacts 54, 56 and electrode 70 shown in FIG. 3) are symmetrically arranged on the receiving platform or in cavity 114 to accept reversible insertion of the coin box 12, and provide positive operative contact with electrodes 50, 52, 70 installed on the underside of the coin box 12. A lid 115 is hingedly affixed to the mobile cart 102 to protect, in the down and closed position, components of the inventorying apparatus 104 provided in a cavity 1 17 of the mobile cart 102 during periods of non-use.

The coin box 12 is received in the manner previously described and weighed by calibrated scale 108 mounted to the mobile cart 102. The calibrated scale 108 may be any scale useful for determining a weight differential of single coins/tokens passed through the scale apparatus. In connection with coin collection box identifying data, including tare weight of the coin box 12 and designated coinage to be received therein, the net weight and aggregate value of the contents collected in the coin box 12 is transferred to the on-board CPU 106 for on-board storage of this data, to be downloaded to a remote CPU 122. It will be understood that data downloading may occur concurrently with an inventorying operation, or subsequently thereto either on an individual host-machine basis or on a batch basis.

Information gathered by memory device 44 of the coin collection box 12 can include host machine 10 identification, time and date information, and data transferred from a coin meter 125 (FIG. 3) in the host machine and stored in the coin collection box 12 for use in comparing count and weight and alerting the appropriate personnel to a measured difference between readings obtained from the calibrated scale 108 and coin meter 125 data.

The mobile cart 102 according to the present invention includes a unitary body 120 containing one or more hoppers 122, 124, 126 each designated by placards 128, 130, 132, respectively, for receiving the designated denomination of coins/tokens after measurement. Coins/tokens may be transferred to a bucket 123 to be received within a selected hopper 122,124, 126. After transfer of coins/tokens to the mobile cart 102, each hopper 122,124,126 is closed with a hinged lid 134, 136, 138, respectively, to be secured in a closed and locked position during transport or non-use of the apparatus 104 or the coins are placed in the hopper through an articulated chute which disallows entry of a retrieving device or human hand to remove the coins/tokens. According to the invention, a mixed aggregation of coins/tokens may be separated by denomination by a coin separator (not shown) into separate hoppers. Also, apparatus may be provided within the hoppers to receive, separate, and stack designated denominations of coins/tokens for reuse in presized, pre-valued stacks.

With reference to FIG. 13, the mobile cart system 100 is preferably operated as follows. The mobile cart 102 is transported adjacent to a host machine 10 designated for coin/token collection. The mobile cart operator extracts the coin box 12 from the host machine 10 and places the coin box 12 on the receiving platform 114 of the mobile cart 102 in the manner previously described with respect to installation within a host machine 10 to achieve full electrical contact between respective sets of electrodes. Aggregate coin/token weight is measured by the calibrated scale 108 after adjusting for coin box tare weight, and this information is transmitted to the on-board CPU 106 via data link 107. Also inputted to the on-board CPU 106 is collection time and date information, mobile cart operator identification, coin box identification and other accounting information gathered from the host machine. According to the invention, and to overcome the prior art problem of lost or unaccounted coins, coin/token data transferred to the on-board CPU 106 from the coin meter 125 is compared with corrected data recorded in the on-board CPU 106 obtained from the calibrated scale 108. a significant discrepancy calculated between the calibrated scale 108 and coin meter 125 causes an alert to be sounded to the mobile cart operator and/or casino operator. The measured discrepancy is further recorded to the remote data collection system 122 for analysis. a paper bill counter (not shown) can be used instead of the coin meter 125 during collection of paper money or scrip. After weighing and accounting of collected moneys information, the contents of the coin box 12 are transferred to the appropriate hopper 122, 124, 126 for secure retention prior to return transport of the mobile cart to a coin/token collection facility during which time data collected in the on-board CPU 106 is preferably downloaded to the remote data collection system 122 for subsequent analysis, reporting, and storage.

With reference to FIG. 14, the present invention further includes mobile apparatus 200 having a self-propelled tow vehicle 202 for towing one or more serially-linked wheeled coin collection carts 204, 206, 208. Alternatively, the mobile apparatus may be configured for operation along tracked or untracked pathways, configured for manual transport by tow handle 209, or self-propelled under automatic robotic delivery system control to deliver inventoried moneys to a remote count room or other receiving facility.

The tow vehicle 202 includes inventorying apparatus 210 for receiving a coin collection box 12 from the host machine 10 in structural and electrical connection with a receiving platform 212 of the tow vehicle 202 in the manner previously described with respect to the mobile cart 102. Aggregate coin/token weight is measured by a calibrated scale (not shown) in the manner previously described, and this information is transmitted to the on-board CPU 214 by wired or modem connection. After inventorying of moneys collected in coin collection box 12, moneys segregated by denomination are transferred to secure receptacles 216, 218, 220 provided in coin collection carts 204, 206, 208, respectively, for secure retention prior to return transport of the mobile apparatus 200, or individual coin collection carts 204, 206, 208, to a coin/token collection facility.

The coin box 12 is reinstalled in the host machine 12, and reinitialized for subsequent use after transfer of moneys to the secured containers provided in the mobile cart 102 or mobile apparatus 200 of the invention. Thus, according to the invention, only a single coin box 12 is required for each host machine 10, eliminating the need to provide a replacement coin box which was previously required when one coin box was removed to a coin/token collection facility. Furthermore, secure collection and accounting of collected coins/tokens is achieved without requiring transport of collected coins/tokens to a remote location for counting.

It is to be understood that the present invention is not limited to the embodiments described above, but encompasses any and all embodiments within the scope of the following claims.

What is claimed is:

1. A coin operated machine having a removably insertable coin box for receiving and storing coins inserted into said coin operated machine, said coin operated machine comprising:

a coin accepting apparatus, performing a function responsive to a coin being accepted, a first memory device and first circuitry for transmitting communication signals from said first memory device, and receiving structure for removably receiving a coin box within said coin operated machine, said receiving structure including a cavity having opposed side walls and a floor said coin box having a receptacle partially defined by opposed side walls for receiving and storing coins inserted into said coin operated machine, guiding structure for guiding said coin box into a predetermined position within said receiving structure of said coin operated machine, and a second memory device and second circuitry for transmitting communication signals between said second memory device and said first circuitry, wherein said receiving structure includes a cavity having opposed side walls and a floor and a projection having a first inclined lateral wall disposed upon said floor and projecting upwardly from said floor. said guiding structure said coin box including a bottom panel, a depending wall depending from said bottom panel and having a second inclined wall complementing and closely cooperating with said projection, whereby lowering said coin box onto said floor of said cavity of said receiving structure causes said coin box to attain said predetermined position within said coin operated machine, and wherein said first circuitry includes first electrodes mounted within at least one of said opposed side walls of said cavity, and said second circuitry includes corresponding, second electrodes mounted within at least one of said opposed side walls of said coin box, said first electrodes and said second electrodes coming into operative proximity when said coin box attains said predetermined position within said coin operated machine.

2. The coin operated machine of claim 1 wherein said projection is tapered and smaller at the top thereof than at the bottom thereof, and said second inclined surface is accordingly tapered such that lowering said coin box onto said floor of said cavity of said coin operated machine causes said coin box to become centered over said projection.

3. The coin operated machine of claim 1 wherein said receiving structure further includes at least one projection having a first inclined lateral wall projecting outwardly from at least one of said side walls, said guiding structure of said coin box including a side panel, an end wall depending from said side panel and having a second inclined wall complementing and closely cooperating with said projection, whereby inserting said coin box into said cavity of said receiving structure causes said coin box to attain said predetermined position within said coin operated machine.

4. The coin operated machine of claim 3 wherein said first electrodes are mounted within said projection, and said second electrodes are mounted within said coin box at said side panel.

5. The coin operated machine of claim 4 wherein said coin operated machine includes a door adjacent said cavity, said door having an open position and a closed position, wherein when said door is in said closed position said second electrodes are urged into contacting relationship with said first electrodes.

6. The coin operated machine of claim 1 wherein said coin box includes a handle.

7. A coin operated machine having a removably insertable coin box for receiving and storing coins inserted into said coin operated machine, said coin operated machine comprising:

a coin accepting apparatus, a first memory device and first circuitry for transmitting communication signals from said first memory device, and receiving structure, said coin box having a receptacle partially defined by opposed side walls, guiding structure adapted to engage said receiving structure, and a second memory device and second circuitry for transmitting communication signals between said second memory device and said first circuitry, wherein said receiving structure includes a cavity having opposed side walls and a floor and a projection having a first inclined lateral wall disposed upon said floor and projecting upwardly from said floor, said guiding structure of said coin box including a bottom panel, a depending wall depending from said bottom panel and having a second inclined wall complementing and closely cooperating with said projection, whereby lowering said coin box onto said floor of said cavity of said receiving structure causes said coin box to attain said predetermined position within said coin operated machine, and wherein said first circuitry includes first electrodes mounted within said receiving structure and said second circuitry includes second electrodes mounted one of said side walls of said coin box, and wherein said first electrodes and said second electrodes are adapted to come into operative proximity when said coin box is received within said receiving structure.

8. The coin operated machine of claim 7 wherein said first circuitry includes a microprocessor.

9. The coin operated machine of claim 7 wherein said coin operated machine includes a door, said door having an open position and a closed position, wherein when said door is in said closed position said second electrodes are urged into operative proximity with said first electrodes.

10. A coin operated machine having a removably insertable coin box for receiving and storing coins inserted into said coin operated machine, said coin operated machine comprising:

a coin accepting apparatus, performing a function responsive to a coin being accepted, a first memory device and first circuitry for transmitting communication signals from said first memory device, and receiving structure for removably receiving a coin box within said coin operated machine, said coin box having a receptacle partially defined by opposed side walls for receiving and storing coins inserted into said coin operated machine, guiding structure for guiding said coin box into a predetermined position within said receiving structure of said coin operated machine, and a second memory device and second circuitry for transmitting communication signals between said second memory device and said first circuitry, and wherein said receiving structure includes a cavity having opposed side walls and a floor and at least one projection having a first inclined lateral wall projecting outwardly from at least one of said side walls, said guiding structure of said coin box including a side panel, an end wall depending from said side panel and having a second inclined wall complementing and closely cooperating with said projection, whereby inserting said coin box into said cavity of said receiving structure causes said coin box to attain said predetermined position within said coin operated machine.

11. The coin operated machine of claim 10 wherein said first circuitry includes first electrodes mounted within said projection, and said second circuitry includes corresponding second electrodes mounted within said coin box at said side panel, said first electrodes and said second electrodes coming into operative proximity when said coin box attains said predetermined position within said coin operated machine.

12. The coin operated machine of claim 10 wherein said first circuitry includes first electrodes mounted within said projection, and said second circuitry includes corresponding, second electrodes mounted within said coin box at said bottom panel, said first electrodes and said second electrodes coming into operative proximity when said coin box attains said predetermined position within said coin operated machine.

13. The coin operated machine of claim 12 wherein said first electrodes are disposed to make sliding contact with said second electrodes when said coin box attains said predetermined position within said coin operated machine, said first electrodes and said second electrodes being arranged serially with respect to the direction of insertion of said coin box into said coin operated machine, whereby contact between said first electrodes and said second electrodes is preserved regardless of whether said coin box is inserted into said coin operated machine in a first directional orientation or in a second directional orientation.

14. The coin operated machine of claim 12 wherein said first electrodes are disposed to make sliding contact with said second electrodes when said coin box attains said predetermined position within said coin operated machine, said first electrodes and said second electrodes being arranged such that they are normal to the direction of insertion of said coin box into said coin operated machine, whereby contact between said first electrodes and said second electrodes is preserved regardless of whether said coin box is inserted into said coin operated machine in a first directional orientation or in a second directional orientation.

15. A coin operated machine having a removably insertable coin box for receiving and storing coins inserted into said coin operated machine, said coin operated machine comprising:

a coin accepting apparatus, performing a function responsive to a coin being accepted, a first memory device and first circuitry for transmitting communication signals from said first memory device, and receiving structure for removably receiving a coin box having a longitudinal axis within said coin operated machine, and said coin box having a receptacle partially defined by opposed side walls for receiving and storing coins inserted into said coin operated machine, guiding structure for guiding said coin box into a predetermined position within said receiving structure of said coin operated machine, and a second memory device and second circuitry for transmitting communication signals between said second memory device and said first circuitry, wherein said receiving structure includes a cavity having opposed side walls and a floor and a projection having a first inclined lateral wall disposed upon said floor and projecting upwardly from said floor, said guiding structure of said coin box including a bottom panel, a depending wall depending from said bottom panel and having a second inclined wall complementing and closely cooperating with said projection, whereby lowering said coin box onto said floor of said cavity of said receiving structure causes said coin box to attain said predetermined position within said coin operated machine, wherein said first circuitry includes first electrodes mounted within said projection, and said second circuitry includes corresponding, second electrodes mounted within said coin box at said bottom panel, said first electrodes and said second electrodes coming into operative proximity when said coin box attains said predetermined position within said coin operated machine, and wherein said first electrodes are disposed to make sliding contact with said second electrodes when said coin box attains said predetermined position within said coin operated machine, said first electrodes and said second electrodes being arranged such that they are normal to the direction of insertion of said coin box into said coin operated machine when said coin box is inserted in a direction parallel to said longitudinal axis, whereby contact between said first electrodes and said second electrodes is preserved regardless of whether said coin box is inserted into said coin operated machine in a first directional orientation or in a second directional orientation.

* * * * *